US005660520A

United States Patent [19]

Scarsdale

[11] Patent Number: 5,660,520

[45] Date of Patent: Aug. 26, 1997

[54] DOWNHOLE CENTRIFUGAL PUMP

[75] Inventor: Kevin T. Scarsdale, Bartlesville, Okla.

[73] Assignee: CAMCO International Inc., Houston, Tex.

[21] Appl. No.: 591,048

[22] Filed: Jan. 25, 1996

[51] Int. Cl.[6] ..... F01D 3/00

[52] U.S. Cl. ..... 415/104; 415/107; 415/199.1

[58] Field of Search ..... 415/111, 199.1, 415/199.2, 199.3, 229, 901, 104, 107

[56] References Cited

U.S. PATENT DOCUMENTS

| | | | |
|---|---|---|---|
| 1,257,793 | 2/1918 | Bodinson | 415/199.1 |
| 2,633,392 | 3/1953 | Luenberger | 415/901 |
| 2,960,937 | 11/1960 | Wright et al. | 415/199.3 |
| 3,058,510 | 10/1962 | Tiraspolsky et al. | 415/107 |
| 3,404,924 | 10/1968 | Choate . | |
| 3,829,179 | 8/1974 | Kurita et al. . | |
| 3,989,409 | 11/1976 | Ioannesian | 415/107 |
| 4,033,647 | 7/1977 | Beavers . | |
| 4,323,285 | 4/1982 | Gilson . | |
| 4,620,601 | 11/1986 | Nagel . | |
| 4,672,249 | 6/1987 | Iwata et al. . | |
| 4,872,808 | 10/1989 | Wilson | 415/901 |
| 5,033,937 | 7/1991 | Wilson . | |
| 5,160,240 | 11/1992 | Wilson . | |
| 5,340,272 | 8/1994 | Fehlau | 415/104 |

FOREIGN PATENT DOCUMENTS

| | | | |
|---|---|---|---|
| 1562535 | 5/1990 | U.S.S.R. | 415/229 |

*Primary Examiner*—John T. Kwon

[57] ABSTRACT

A centrifugal pump adapted to be positioned in a wellbore in an inverted position to pump fluids downhole includes a pump housing, a rotatable shaft positioned within the pump housing, at least one pump stage positioned within the pump housing, with each pump stage comprising an impeller connected to and fixed relative to the shaft, and a stationary diffuser, and an upthrust bearing assembly positioned within the pump housing and comprising a rotatable thrust plate connected to the shaft and cooperating with a stationary thrust plate supported to the pump housing. The upthrust bearing assembly eliminates the need for a separate costly bearing assembly, such as would be included within an additional motor protector, when a centrifugal pump is positioned in a wellbore in an inverted position to pump fluids downhole.

5 Claims, 1 Drawing Sheet

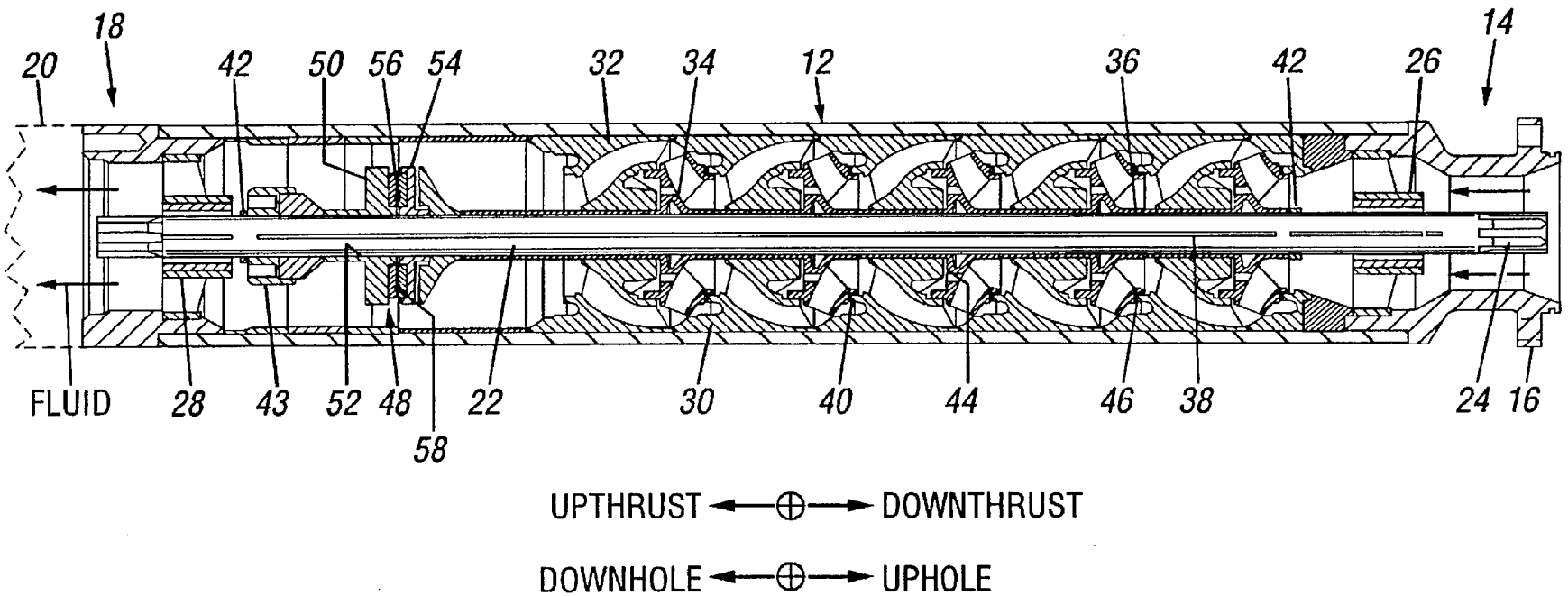
14
16
24
26
42
38
36
46
44
12
40
34
30
32
22
54
58
56
48
50
52
42
43
28
18
20
FLUID
UPTHRUST
DOWNTHRUST
DOWNHOLE
UPHOLE

DOWNHOLE CENTRIFUGAL PUMP

BACKGROUND OF THE INVENTION

1. Field of the Invention

The present invention relates to electric submergible pumping systems for recovering liquids from a wellbore and, more particularly, to a submergible centrifugal pump adapted to be positioned in a wellbore in an inverted position to pump fluids downhole.

2. Description of Related Art

Electric submergible pumping systems are commonly used to recover liquids from subterranean wellbores, and generally comprise an electric motor that operates a multi-stage centrifugal pump. The usual configuration is for the pump to be placed in the wellbore above or "uphole" of the motor, with the pump's impellers being rotated so as to move the fluids upwardly, i.e. uphole. There are applications where the pump is inverted in the wellbore so that the pump is below or "downhole" of the motor, and the fluids are moved downwardly, i.e. downhole, such as in a fluid reinjection application. This inverted arrangement can cause problems such as premature bearing wear, excessive thrust washer wear, and pump failure.

The inverted arrangement causes problems because the typical centrifugal pump is designed to move fluids upwardly, so in a typical arrangement the weight of and the downthrust from the pump's impellers are supported by a relatively large thrust bearing located within the motor protector, which is positioned between the pump and the electric motor, as is well known to those skilled in the art. The thrust bearing in the motor protector is lubricated by a secondary fluid that is isolated from the wellbore fluids and that has greater lubricating qualities, so that the thrust bearing can carry greater loads than a bearing lubricated by the wellbore fluids. When the pump is inverted the weight of the impellers and downthrust cannot be carded by the protector's thrust bearing without rigidly linking the pump shaft and the protector shaft together. Rigid shaft connections have been used, but such connections can be very difficult to properly install with the correct tolerances in remote field locations.

When the pump's shaft and the protector's shaft are not rigidly connected, then in a conventional pump the weight of the impellers will be distributed over the relatively very thin upthrust washers on each impeller. When the motor is activated and the pump is rotated, the weight load on these thin upthrust washers will exceed their design load capability, which results in destruction of these washers. Thereafter, metal-to-metal contact between the rotating impellers and the stationary diffusers occurs which destroys the pump.

Further, when a pump is inverted the downthrust is reduced which causes the pump to be operated below its best efficiency point. In a typical pump installation, downthrust is comprised of an unbalanced hydraulic force and the weight of the impellers. When this typical pump is operated, the downthrust and impeller weight are collinear. Thus, the pump is designed so that the downthrust is approximately zero at the best efficiency point of the pump. Inverting the pump causes a reduction of the downthrust because the impeller weight is now acting opposite to the downthrust. This means that when the inverted pump is operating at its best efficiency point the impellers will be in upthrust and the effective operating range of the pump will be reduced unless an additional bearing is used to carry this extra upthrust.

To handle this extra upthrust from an inverted pump an additional motor protector bearing has been attached to the shaft of the pump on its fluid outlet end. This extra protector is a costly addition to this problem. There is a need for an inexpensive upthrust bearing that can be easily incorporated into a conventional centrifugal pump.

SUMMARY OF THE INVENTION

The present invention has been contemplated to overcome the foregoing deficiencies and meet the above described needs. Specifically, the present invention is a centrifugal pump adapted to be positioned in a wellbore in an inverted position to pump fluids downhole. This pump includes a pump housing, a rotatable shaft positioned within the pump housing, at least one pump stage positioned within the pump housing, with each pump stage comprising an impeller connected to and fixed relative to the shaft, and a stationary diffuser, and an upthrust bearing assembly positioned within the pump housing and comprising a rotatable thrust plate connected to the shaft and cooperating with a stationary thrust plate supported to the pump housing. The upthrust bearing assembly can be easily added into an existing centrifugal pump, and eliminates the need for a separate costly bearing assembly, such as would be included within an additional motor protector, when a centrifugal pump is positioned in a wellbore in an inverted position to pump fluids downhole.

BRIEF DESCRIPTION OF THE DRAWING

The Drawing is an elevational cut-away view of one preferred embodiment of a centrifugal pump of the present invention.

DETAILED DESCRIPTION OF THE PREFERRED EMBODIMENTS

As briefly described above, the present invention is a centrifugal pump adapted to be positioned in a wellbore in an inverted position to pump fluids downhole. The pump includes a pump housing, a rotatable shaft positioned within the pump housing, at least one pump stage positioned within the pump housing, with each pump stage comprising an impeller connected to and fixed relative to the shaft, and a stationary diffuser, and an upthrust bearing assembly positioned within the pump housing and comprising a rotatable thrust plate connected to the shaft and cooperating with a stationary thrust plate supported to the pump housing.

For the purposes of this discussion it will be assumed that the present invention is a centrifugal pump used within an electric submergible pumping system. However, it should be understood that the present invention can be used within other fluid moving devices, such as positive displacement pumps, rotary pumps, downhole turbines and motors. Further, the present discussion will assume that the pump, and therefore the pump's impeller and diffuser, is generally in a vertical position with respect to the earth so that certain items can be referred to herein as an "upper" or a "lower" member, yet there is no need that the present invention be used in any particular orientation, so that it can be used vertically, horizontally, or inclined. It also can be used in an industrial application on the earth's surface, as desired, in a horizontal, inclined or vertical orientation.

A centrifugal pump 10, being one preferred embodiment of the present invention, is shown in the Drawing with an upward direction, i.e. uphole, being towards the right of the Drawing, and a downward direction, i.e. downhole, being towards the left of the Drawing. The pump 10 generally comprises a pump casing or housing 12 with a first end 14 having a flange 16 adapted for interconnection to an electric submergible pumping system's motor protector (not shown) or electric motor (not shown), as is well known to those skilled in the art. A second end 18 of the pump housing 12 includes interconnection devices 20, such as threads, for interconnection to a fluid discharge conduit (not shown).

Extending, preferably, coaxially through the pump housing 12 is a rotatable shaft 22 that includes splines 24 on one end for power transfer interconnection with the shaft (not shown) of the motor protector, electric motor, and/or tandem pump. The shaft 22 is centered and journaled for rotary motion by a first longitudinal bearing 26 and a second longitudinal bearing 28 affixed within the housing 12 adjacent each end thereof.

Positioned within the housing 12 between the first and the second longitudinal bearings 26 and 28 is at least one pump stage 30, and preferably multiples of such pump stages, with each pump stage 30 comprising a stationary diffuser 32 and a cooperable rotating impeller 34, as is well known to those skilled in the art. The impellers 34 are connected to the shaft 22 so that they rotate with the shaft 22 by way of pins or keys 36 that fit into a longitudinal slot 38 in the outer surface of the shaft 22. The impellers 34 are also fixed relative to the shaft 22 so that the impellers 22 will remain generally in the same longitudinal position on the shaft 22 by way of pins or keys. This pump configuration is known as a fixed impeller design, which is distinct from a floating impeller design where the impellers are permitted to move longitudinally relative to the shaft. The impellers 34 are preferably fixed relative to the shaft 22 with collet rings 42 that are rigidly connected to the shaft 22 to abut a first (uppermost) impeller 34 and a lower compression nut 43.

Each impeller 34 includes a relatively thin upthrust washer 44 and a relatively thin downthrust washer 46. As has been described previously, a centrifugal pump is conventionally operated with the first end 14 of the pump 10 downhole of the second end 18, so that fluids enter the pump housing 12 adjacent the first end 14 and are moved upwardly through the pump. In this arrangement, minor variances in downthrust and upthrust are supported by the washers 44 and 46. Relatively large downthrust forces are transferred to the shaft 22 and then to the relatively large thrust bearing (not shown) within the conventional motor protector (not shown). However, in the inverted position, as the pump of the present invention is specially adapted to be positioned, the downthrust is decreased and the upthrust increased. To carry this upthrust a new upthrust bearing assembly is added to the pump to eliminate the need for a separate and expensive motor protector connected to the second end of the pump and without having to rigidly connect the pump's shaft to the shaft of the motor protector.

An upthrust bearing assembly 48 is positioned within the pump housing 12 preferably between the first and the second longitudinal bearings 26 and 28. The upthrust bearing assembly 48 is preferably positioned adjacent the second end 18 of the pump 10 so that the combined upthrust of all of the impellers 34 can be transferred thereto, as will be described below. The upthrust bearing assembly 48 comprises a stationary thrust plate 50 that is rigidly mounted within and supported by the housing 12. The stationary thrust plate 50 includes a longitudinal opening 52 therethrough through which the shaft 22 extends. Rigidly mounted to the shaft 22 is a rotatable thrust plate 54 that bears upon the stationary thrust plate 50. The opposed sides of the stationary and the rotatable thrust plates 50 and 54 each include replaceable annular bearing pads 56 made from silicon carbide or other suitable material, with the bearing pad 56 of the stationary thrust plate 50 having at least one and preferably several straight or curved radially extending grooves 58 therein to assist in the removal of debris from between the contacting pads 56. The pads 56 are glued into place either on or into a recess the thrust plates 50 and 54, and are kept from rotating by a pin (not shown) protruding from the face of the thrust plate.

With the present invention, the weight of the impellers 34 and any upthrust caused when the pump is operated, especially during start-up, are transferred from impeller hub to impeller hub 40, to the shaft 22, to the rotatable thrust plate 54, to the stationary thrust plate 50, and then to the pump casing 12, thereby overcoming the previous problems with using centrifugal pumps in an inverted position. Additionally, if two inverted pumps are to be connected together, then each such inverted pump can include the upthrust bearing assembly of the present invention, or only the lowermost pump would have the upthrust bearing assembly since it will have sufficient load bearing capability to carry the upthrust and weight of both pumps.

Whereas the present invention has been described in relation to the Drawings attached hereto, it should be understood that other and further modifications, apart from those shown or suggested herein, may be made within the scope and spirit of the present invention.

What is claimed is:

1. A centrifugal pump comprising:

a pump housing having a first end for receiving fluid and a second end for discharging the fluid;

a rotatable shaft positioned within the pump housing;

at least one pump stage positioned within the pump housing, each pump stage comprising an impeller connected to and fixed relative to the shaft, and a stationary diffuser;

a well fluid lubricated thrust bearing means located adjacent the second end of the pump housing for carrying the static weight of the shaft and impellers directed towards the second end of the pump housing when the pump is idle and for carrying any thrust forces directed in the same direction as the fluid flow when the pump is in operation.

2. A centrifugal pump of claim 1 and further comprising a plurality of pump stages with the plurality of impellers connected to and fixed relative to the shaft by a first and a second compression rings on the shaft.

3. A centrifugal pump of claim 1 wherein the rotatable thrust plate includes an annular bearing pad affixed thereto having a bearing face cooperable with a bearing face of an annular bearing pad affixed to the stationary thrust plate.

4. A centrifugal pump of claim 3 wherein the bearing face of the annular bearing pad affixed to the stationary thrust plate includes at least one radial groove therein.

5. A centrifugal pump of claim 1 wherein the thrust bearing means further comprises a rotatable plate connected to the shaft and cooperating with a stationary thrust plate supported to the pump housing.

* * * * *